US007413291B2

(12) United States Patent
Ito

(10) Patent No.: US 7,413,291 B2
(45) Date of Patent: Aug. 19, 2008

(54) INK JET HEAD, CONNECTING SHEET, COMPOSITE SHEET, AND METHOD OF MANUFACTURING INK JET HEAD AND COMPOSITE SHEET

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 421 days.

(21) Appl. No.: 11/237,947

(22) Filed: Sep. 29, 2005

(65) Prior Publication Data

US 2006/0068630 A1 Mar. 30, 2006

(30) Foreign Application Priority Data

Sep. 30, 2004 (JP) ..... 2004-285865

(51) Int. Cl.
*B41J 2/045* (2006.01)
*B41J 2/14* (2006.01)

(52) U.S. Cl. ..... 347/71; 347/50

(58) Field of Classification Search ..... 347/50, 347/58, 59, 68, 70, 71
See application file for complete search history.

(56) References Cited

U.S. PATENT DOCUMENTS 5,838,519 A 11/1998 Takizawa et al.
2005/0062806 A1* 3/2005 Terakura et al. ..... 347/72
2006/0071959 A1* 4/2006 Ito et al. ..... 347/9

FOREIGN PATENT DOCUMENTS

JP 11334061 12/1999

* cited by examiner

*Primary Examiner*—An H Do
(74) *Attorney, Agent, or Firm*—Banner & Witcoff, Ltd.

(57) ABSTRACT

An ink jet head is provided with a main body, a wired sheet, and a connecting sheet. The main body is provided with a plurality of sets and each set includes an input terminal, an actuator, a pressure chamber and a nozzle. The wired sheet is provided with a plurality of sets and each set includes a signal line and an output terminal. The connecting sheet is provided with an insulating sheet and a plurality of sets and each set includes first terminal formed on a first face of the insulating sheet and a second terminal formed on a second face of the insulating sheet. In each set, the signal line, output terminal, second terminal, first terminal, input terminal and actuator are electrically connected. When a voltage is applied to the actuator in a selected set via the signal line, output terminal, second terminal, first terminal and input terminal, pressure is applied to ink within the pressure chamber in the selected set, and this ink jets from the nozzle in the selected set.

10 Claims, 11 Drawing Sheets

(a)

(b)

INK JET HEAD, CONNECTING SHEET, COMPOSITE SHEET, AND METHOD OF MANUFACTURING INK JET HEAD AND COMPOSITE SHEET

CROSS-REFERENCE TO RELATED APPLICATION

This application claims priority to Japanese Patent Application No. 2004-285865, filed on Sep. 30, 2004, the contents of which are hereby incorporated by reference into the present application.

BACKGROUND OF THE INVENTION

1. Field of the Invention

The present invention relates to an ink jet head to be mounted on an ink jet printer. Further, the present invention relates to a connecting sheet and a composite sheet to be used in the ink jet head. Moreover, the present invention relates to a method of manufacturing the ink jet head and the composite sheet.

2. Description of the Related Art

Ink jet printers are well known. An ink jet printer is provided with an ink jet head that discharges ink. The ink jet head is provided with a plurality of nozzles, a plurality of pressure chambers, and a plurality of actuators. Each nozzle is communicated with a corresponding pressure chamber. Each pressure chamber is coupled with a corresponding actuator. When one of the actuators is activated, pressure is increased of ink housed in the corresponding pressure chamber coupled with the activated actuator, and the ink is discharged from the nozzle communicated with this pressure chamber.

The plurality of actuators is provided with, for example, one piezoelectric sheet. This piezoelectric sheet faces the plurality of pressure chambers. One common electrode is formed on a first face of the piezoelectric sheet, and extends over the plurality of pressure chambers. A plurality of individual electrodes is formed on a second face of the piezoelectric sheet. Each individual electrode corresponds to one of the pressure chambers in their positional relationship. When a driving voltage (a driving signal) is applied to one of the individual electrodes, an electric field is generated between that individual electrode and the common electrode, and the portion of the piezoelectric sheet disposed between the individual electrode and the common electrode contracts. When the piezoelectric sheet contracts, there is a change in the volume of the pressure chamber coupled with the individual electrode. As a result, pressure (discharging energy) is applied to the ink within the pressure chamber. A conventional ink jet head is taught in Japanese Laid-Open Patent Application Publication No. H11-334061.

One of a plurality of signal lines is connected to a corresponding individual electrode in order to apply the driving voltage thereto. Each of the individual electrodes has an input terminal connected therewith in order to connect the signal line to the individual electrode. The ink jet head taught in Japanese Laid-Open Patent Application Publication No. H11-334061 uses a wired sheet on which are formed a plurality of output terminals and a plurality of signal lines that transmit driving voltage. Each output terminal is connected to a corresponding signal line. In this ink jet head, each output terminal formed on the wired sheet is connected directly to a corresponding input terminal.

A surface face of the wired sheet is covered by an insulating film. The insulating film can be formed with a solder resist film, for example. The insulating film covers the plurality of signal lines. A plurality of holes is formed in the insulating film at locations corresponding to the output terminals of the wired sheet. Each output terminal is exposed in a different corresponding hole. Since the output terminals formed on the wired sheet are not covered by the insulating film, these output terminals can make contact with the input terminals.

Since the plurality of signal lines of the wired sheet is covered by the insulating film, there is no short circuiting between these signal lines even if ink splashes or dust adhere to the wired sheet. A technique pertaining to this is taught in Japanese Laid-Open Patent Application Publication No. H10-256688.

BRIEF SUMMARY OF THE INVENTION

In recent years, the nozzles and pressure chambers in ink jet heads are disposed with a high density in response to the demand for increased image resolution and high-speed printing. This is accompanied by disposing the signal lines and output terminals with a high density on the wired sheet. There is a narrower distance between the signal lines and output terminals in the wired sheets on which the signal lines and output terminals are disposed with a high density. Consequently, when the holes are formed in the insulating film, not only the output terminals whose exposure is intended are exposed from these holes, but also a part of an adjacent signal line for another output terminal may also be exposed. In this case, if ink splashes or dusts adhere to the wired sheet, there is a problem that there may be a short circuit between the output terminal and the adjacent signal line for another output terminal. Or, there is a problem that there may be a short circuit between the signal lines. In order to prevent this, it is necessary to form minute holes in the insulating film that allow only the output terminals to be exposed. Normally, the holes for exposing the output terminals are formed by etching the insulating film. However, in order to form the minute holes in the insulating film that allow only the output terminals to be exposed, it is necessary to perform patterning of a photo resist that has minute openings in positions that correspond accurately to the output terminals. A complex process using expensive apparatus is required to perform patterning of a high-density photo resist on a wired sheet, and this increases the manufacturing cost of the wired sheet.

The present invention solves the aforementioned problem. In the present invention it is not necessary to form minute holes in an insulating film. A structure is realized in which, even though minute holes are not formed in the insulating film, short circuiting does not occur when ink splashes or dust adhere to a wired sheet.

An ink jet head of the present teachings is provided with a main body, a wired sheet, and a connecting sheet. The main body is provided with a plurality of input terminals, a plurality of actuators, a plurality of pressure chambers and a plurality of nozzles. Each actuator is electrically connected to a corresponding input terminal, each pressure chamber is coupled with a corresponding actuator, and each nozzle is communicated with a corresponding pressure chamber. A set is formed by an input terminal, an actuator, a pressure chamber and a nozzle. The main body is provided with a plurality of these sets. With this main body, when a voltage is applied to the actuator in a selected set via the input terminal in the selected set, pressure is applied to ink within the pressure chamber in the selected set, and this ink jets from the nozzle in the selected set.

A wired sheet is provided with a plurality of signal lines and a plurality of output terminals. Each output terminal is electrically connected to a corresponding signal line. A set is formed by a signal line and an output terminal. The wired sheet is provided with a plurality of these sets.

A connecting sheet is provided with an insulating sheet and a plurality of first terminals formed on a first face of the insulating sheet and a plurality of second terminals formed on a second face of the insulating sheet. Each second terminal is electrically connected to a corresponding first terminal. A set is formed by a first terminal and a second terminal. The connecting sheet is provided with a plurality of these sets. Each set of the connecting sheet uniquely corresponds to one of the sets of the main body and to one of the sets of the wired sheet.

The connecting sheet is located between the main body and the wired sheet. The first terminal in each set of the connecting sheet is electrically connected to the input terminal in the corresponding set of the main body. The second terminal in each set of the connecting sheet is electrically connected to the output terminal in the corresponding set of the wired sheet. In each set, an electric connection from the signal line to the actuator through the output terminal, second terminal, first terminal and the input terminal is completed.

In this ink jet head, the connecting sheet is located between the main body and the wired sheet. As a result, dust, splashes of ink that have been splashed from the main body side, etc., are intercepted by the connecting sheet made of the insulating material. Ink splashes and dust are prevented from adhering to the wired sheet. By this means, the input terminals of the main body are prevented from short circuiting with the signal lines for other input terminals, and signal lines are prevented from short circuiting with one another.

With this ink jet head, it is not necessary to form an insulating film that has minute holes, and the manufacturing cost of the wired sheet can be reduced.

BRIEF DESCRIPTION OF THE DRAWINGS

FIG. 5(*b*) shows a plan view of the FPC in which insulating film has been removed and seen from the actuator unit side.

FIG. 6(*b*) shows a plan view of the connecting sheet seen from the actuator unit side.

DETAILED DESCRIPTION OF THE DRAWINGS

Figure 1:
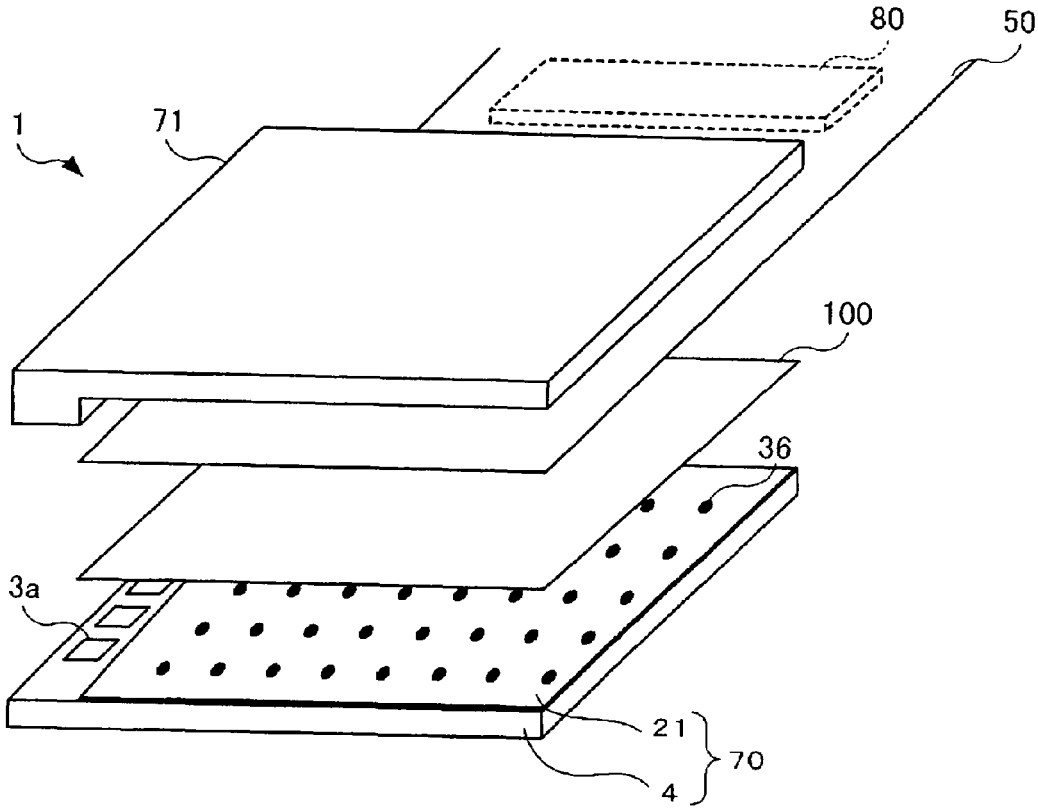
FIG. 1 shows an exploded perspective view of an ink jet head of an embodiment of the present invention.

An ink jet head of an embodiment of the present invention will now be described. FIG. 1 shows an exploded perspective view of an ink jet head 1. As shown in FIG. 1, the ink jet head 1 is provided with a main body 70, an ink reservoir unit 71, a flexible printed wired sheet (FPC: Flexible Printed Circuit) 50, and a connecting sheet 100. The main body 70 has a rectangular flat bottom face for discharging ink onto a printing sheet. The ink reservoir unit 71 has an ink reservoir for storing ink to be supplied to the main body 70, and is connected with ink supply holes 3*a* formed in an upper face of the main body 70. The main body 70 is provided with an actuator unit 21 and an ink flow channel unit 4. The actuator unit 21 is disposed on an upper face of the ink flow channel unit 4. A driver IC 80 for driving the actuator unit 21 is fixed to the FPC 50. The FPC 50 is provided with a wired pattern for transmitting driving signals from the driver IC 80 to the actuator unit 21. The connecting sheet 100 is disposed between the actuator unit 21 and the FPC 50. The connecting sheet 100 receives driving signals output from the FPC 50 and sends these to the actuator unit 21.

The ink reservoir unit 71 stores ink supplied from an ink tank (not shown) within the ink reservoir. Further, parts of the ink reservoir unit 71 that face the ink supply holes 3*a* are formed so as to protrude further downwards than surrounding parts. The ink reservoir unit 71 is fixed such that only these protruding parts make contact with the ink flow channel unit 4. As a result, there is a gap between the main body 70 and the region of the ink reservoir unit 71 without the protruding parts, and the actuator unit 21, the connecting sheet 100, and the FPC 50 are disposed in this gap.

Figure 2:
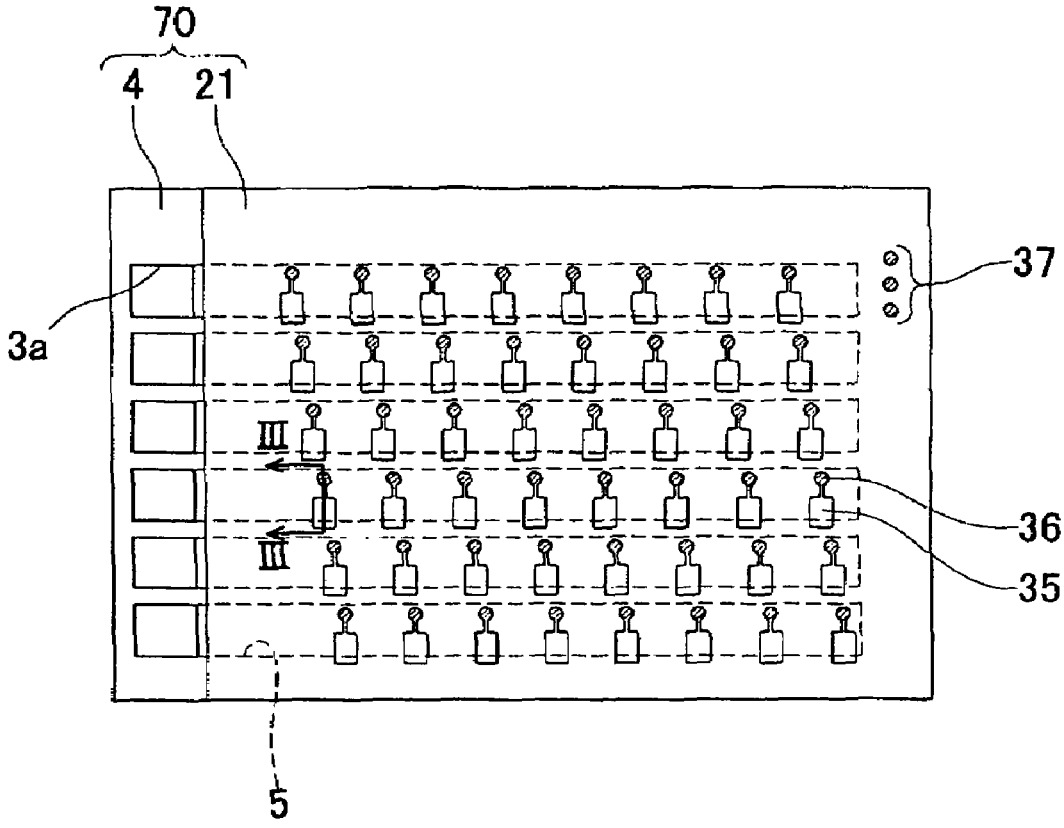
FIG. 2 shows a plan view of a main body.
Figure 3:
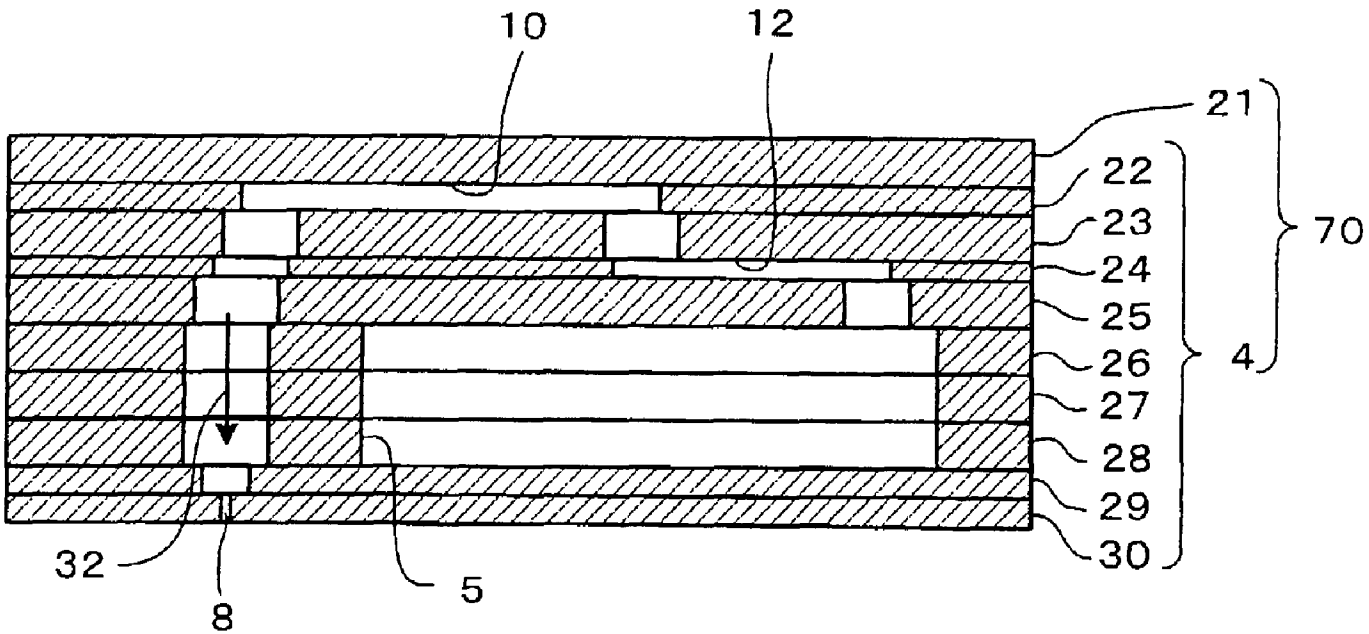
FIG. 3 shows a cross-sectional view along the line III-III in FIG. 2.

The main body 70 will be described with reference to FIGS. 1 to 3. FIG. 2 shows a plan view of the main body 70. FIG. 3 shows a cross-sectional view along the line III-III shown in FIG. 2. The main body 70 is provided with the actuator unit 21 and the ink flow channel unit 4. A plurality of nozzles 8 (see FIG. 3), these discharging ink from a first face of the ink flow channel unit 4 (the lower face in FIG. 1), are disposed in the ink flow channel unit 4. The first face having the plurality of nozzles 8 is termed an ink discharging face. The actuator unit 21 abuts a second face of the ink flow channel unit 4, this being a face at the opposite side of the ink flow channel unit 4 from the ink discharging face.

As shown in FIG. 2, six of the ink supply holes 3*a* are aligned along one edge of the second face of the ink flow channel unit 4. Six manifolds 5 are formed in the ink flow channel unit 4. The six manifolds 5 extend in a mutually parallel manner, and communicate via the ink supply holes 3*a* with the ink reservoir of the ink reservoir unit 71.

As shown in FIG. 3, a plurality of individual ink passages 32 is formed in the ink flow channel unit 4. The individual ink passages 32 encompass the nozzle 8 and the pressure chamber 10 that communicates with this nozzle 8. The pressure chambers 10 have a rectangular plan face, and are disposed in a matrix pattern when viewed from the plan face of the ink flow channel unit 4. The pressure chambers 10, when viewed from the plan face, are positioned to overlap with the manifolds 5, and are aligned in the direction in which the manifolds 5 extend. Each of the pressure chambers 10 communicates with the manifold 5 via an aperture 12.

The cross-sectional structure of the main body 70 will be described with reference to FIG. 3. As shown in FIG. 3, the nozzle 8 communicates with the manifold 5 via the pressure chamber 10 and the aperture 12. In the main body 70, one of the individual ink passages 32 is formed for each nozzle 8, this individual ink passage 32 passing from an exit of the manifold 5 to the nozzle 8 via the aperture 12 and the pressure chamber 10.

The main body 70 is a stacked structure in which a total of ten sheet members are stacked. Sequentially from the top these are: the actuator unit 21, a cavity plate 22, a base plate 23, an aperture plate 24, a supply plate 25, manifold plates 26, 27, and 28, a cover plate 29, and a nozzle plate 30. All the plates except for the actuator unit 21 are formed from metal, and these nine metal plates comprise the ink flow channel unit 4.

The cavity plate 22 is a metal plate wherein a plurality of holes that form the pressure chambers 10 are formed. The base plate 23 is a metal plate provided with communicating holes allowing each of the pressure chambers 10 to communicate with its corresponding aperture 12, and communicating holes for allowing each of the pressure chambers 10 to communicate with its corresponding nozzle 8. The aperture plate 24 is a metal plate provided with holes that form the apertures 12 and with communicating holes for allowing each of the pressure chambers 10 to communicate with its corresponding nozzle 8. The supply plate 25 is a metal plate provided with communicating holes for allowing the apertures 12 to communicate with the manifold passages 5, and with communicating holes for allowing each of the pressure chambers 10 to communicate with its corresponding nozzle 8. The manifold plates 26, 27, and 28 are metal plates provided with holes that form the manifold passages 5, and with communicating holes for allowing each of the pressure chambers 10 to communicate with its corresponding nozzle 8. The cover plate 29 is a metal plate provided with communicating holes for allowing each of the pressure chambers 10 to communicate with its corresponding nozzle 8. The nozzle plate 30 is a metal plate in which the plurality of nozzles 8 is formed. A through hole, this passing through the ink flow channel unit 4, is formed near each of both longitudinal edges of all of these nine metal plates for fixing positional relationship between the nine plates. The nine metal plates are stacked with a positional relationship such that they form the individual ink passages 32.

Figure 4:
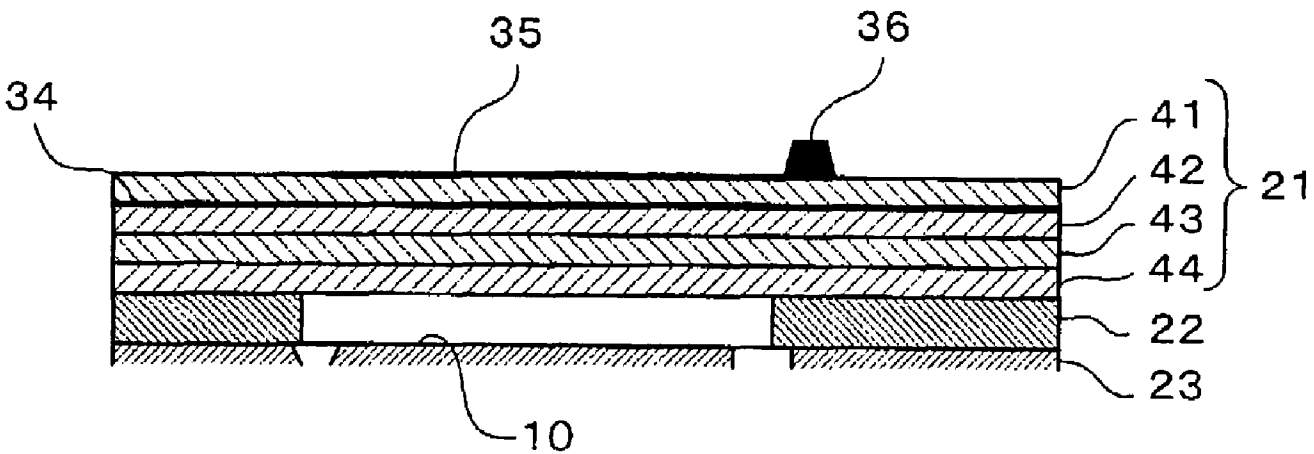
FIG. 4 shows a partially expanded cross-sectional view of an actuator unit and a pressure chamber.

Next, the configuration of the actuator unit 21 will be described with reference to FIG. 4. The actuator unit 21 is stacked on the cavity plate 22 that forms the uppermost layer of the ink flow channel unit 4. FIG. 4 shows a partially expanded cross-sectional view of the actuator unit 21 and the pressure chamber 10. As shown in FIG. 4, the actuator unit 21 is provided with four piezoelectric sheets 41, 42, 43, and 44, each having a thickness of approximately 15 μm. The piezoelectric sheets 41 to 44 are disposed to as to extend across the plurality of pressure chambers 10 of the main body 70. The piezoelectric sheets 41 to 44 can be made from ferroelectric lead zirconate titanate (PZT) ceramic material.

Individual electrodes 35 are formed on the uppermost piezoelectric sheet 41. A common electrode 34 with a thickness of approximately 2 μm is formed across an entire sheet face between the uppermost piezoelectric sheet 41 and the piezoelectric sheet 42 formed below the piezoelectric sheet 41. Electrodes are not disposed between the piezoelectric sheet 42 and the piezoelectric sheet 43. Of the four piezoelectric sheets 41 to 44, only the uppermost piezoelectric sheet 41 becomes an activate layer when an electric field is applied. The other three layers are non-active layers. The individual electrodes 35 and the common electrode 34 can be made from metal material such as, for example, Ag—Pd.

The individual electrodes 35 have a thickness of approximately 1 μm, and have a rectangular plan face that resembles the pressure chambers 10. As shown in FIG. 2, each of the individual electrodes 35 has a region that extends from one side thereof, and a tip of this region is electrically connected with an input terminal 36. The input terminals 36 have a truncated cone shape with a diameter of approximately 160 μm. The input terminals 36 are composed of, for example, metal that contains glass flit, and can be bonded to a top surface of the extending regions of the individual electrodes 35. As shown in FIGS. 1 and 2, the plurality of input terminals 36 is exposed at an upper face (the upper face in FIG. 1) of the actuator unit 21.

The common electrode 34 is connected, via a wire (not shown) formed in a through hole that passes through the actuator unit 21, with common electrode terminals 37 (see FIG. 2) formed on the piezoelectric sheet 41. The common electrode terminals 37 are earthed via the connecting sheet 100 and the FPC 50, and the common electrode 34 maintains an identical ground voltage in all the regions corresponding to the pressure chambers 10.

Figure 5:
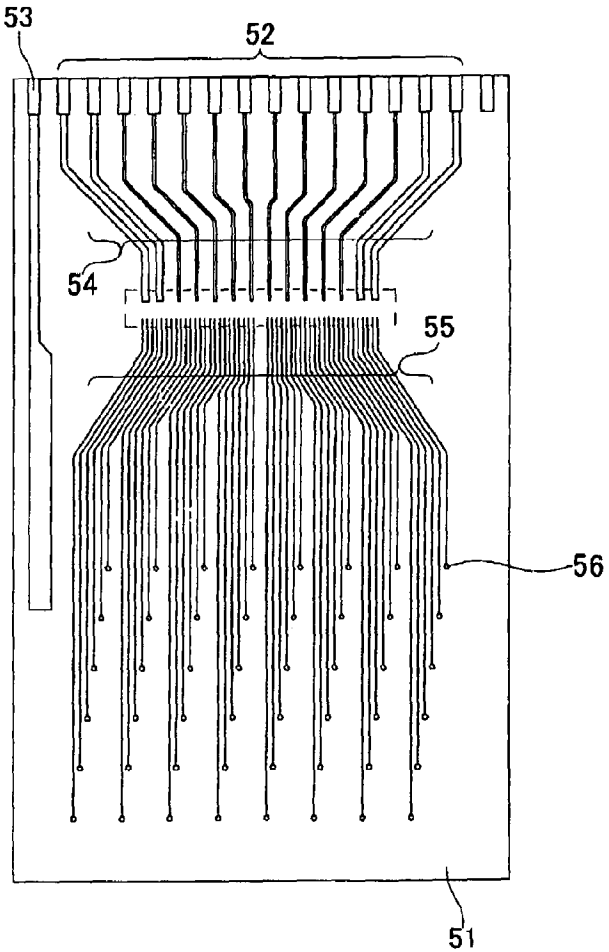
FIG. 5(*a*) shows a plan view of a flexible printed wired sheet (FPC) seen from an actuator unit side.
Figure 5:
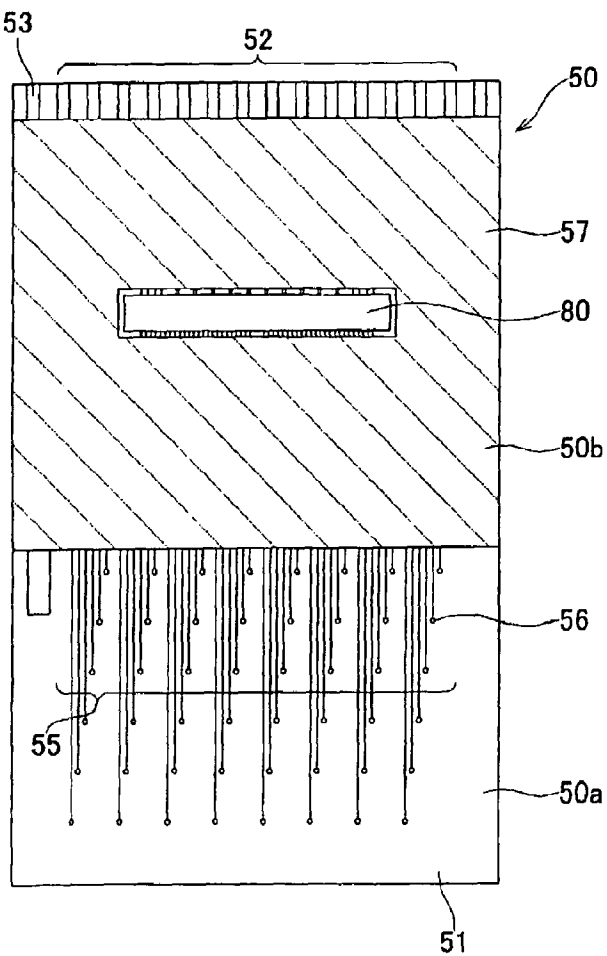

Next, the FPC 50 will be described with reference to FIG. 5. FIG. 5 shows a plan view of the FPC 50 seen from the actuator unit 21 side. FIG. 5(*a*) shows the FPC 50, and FIG. 5(*b*) shows the FPC 50 from which an insulating film 57 has been removed. As shown in FIG. 5, the FPC 50 has a plate shaped base 51 that consists of a polyimide film with a thickness of approximately 50 μm, and a copper foil wired pattern formed by etching on this base 51. A plurality of controlling terminals 52, a common terminal 53, a plurality of controlling signal lines 54, a plurality of driving signal lines 55, and a plurality of output terminals 56 are formed on the base 51. Each controlling signal line 54 is connected with a corresponding controlling terminal 52. Each driving signal line 55 is connected with a corresponding output terminal 56. The FPC 50 has a rectangular plan face that extends in one direction.

As shown in FIG. 5(*a*), the FPC 50 has a covered region 50*b* that is covered by the insulating film 57, and a non-covered region 50*a* that is not covered by the insulating film 57. The insulating film 57 can be formed with a solder resist film. However, the insulating film 57 is not limited to the solder resist film. The plurality of output terminals 56 is formed in the non-covered region 50*a*. A part of the plurality of signal lines 55 is also exposed in the non-covered region 50*a*. The driver IC 80 connected with the plurality of controlling signal lines 54 and the plurality of driving signal lines 55 is fixed to the base 51 at nearly center of the covered region 50*b*. The driver IC 80 outputs driving signals that are applied to the individual electrodes 35 (to the input terminals 36) of the actuator unit 21. The driving signals output by the driver IC 80 are transmitted by the driving signal lines 55, and are output from the output terminals 56. The driver IC 80 outputs the driving signal selectively to one or a plurality of the driving signal lines 55.

As shown in FIG. 1, a part of the region of the FPC 50 is covered by the connecting sheet 100, and the remaining region thereof is not covered by the connecting sheet 100. The region covered by the connecting sheet 100 corresponds to the non-covered region 50*a* shown in FIG. 5(*a*). The region not covered by the connecting sheet 100 corresponds to the covered region 50*b* shown in FIG. 5(*a*).

As shown in FIG. 5, the controlling terminals 52 are disposed along one edge of the covered region 50*b* side of the base 51. The common terminal 53 is disposed adjoining the controlling terminals 52, and extends across both the covered region 50*b* and the non-covered region 50*a*. The part of the common terminal 53 that is disposed in the non-covered region 50*a* faces, via the connecting sheet 100, the common electrode terminals 37 exposed at the surface face of the actuator unit 21.

The plurality of driving signal lines 55 extends across both the covered region 50*b* and the non-covered region 50*a*. Each driving signal line 55 is connected with corresponding one of the output terminals 56 in the non-covered region 50*a*. The smallest pitch between the driving signal lines 55 is approximately 45 μm. The output terminals 56 are disposed in a matrix shape and face, via the connecting sheet 100, the input terminals 36 exposed at the top surface of the actuator unit 21.

Figure 6:
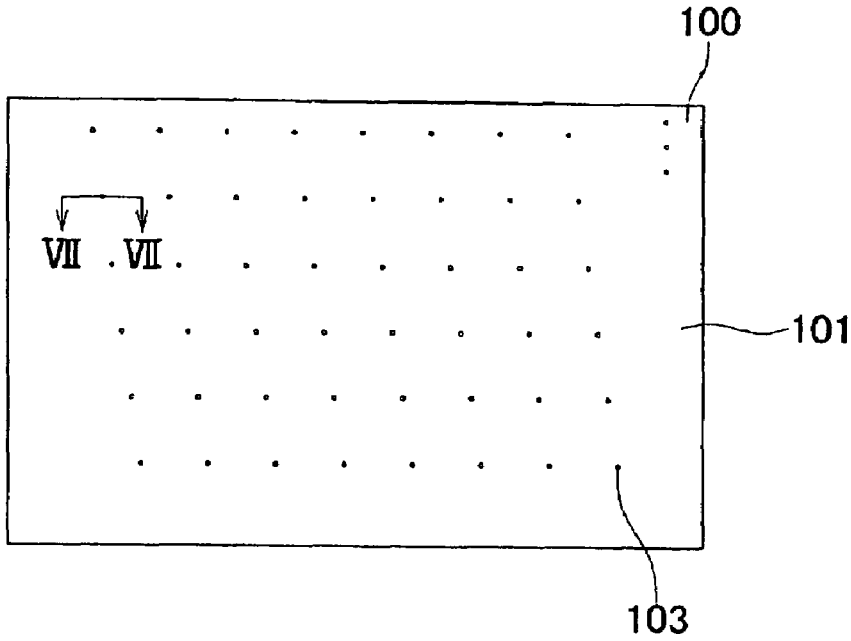
FIG. 6(*a*) shows a plan view of a connecting sheet seen from an FPC side.
Figure 6:
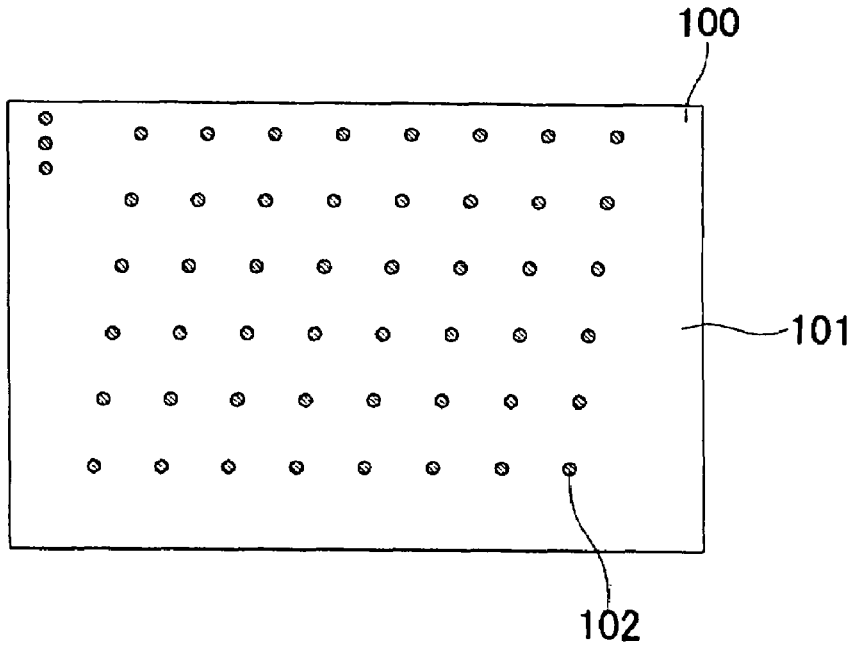
Figure 7:
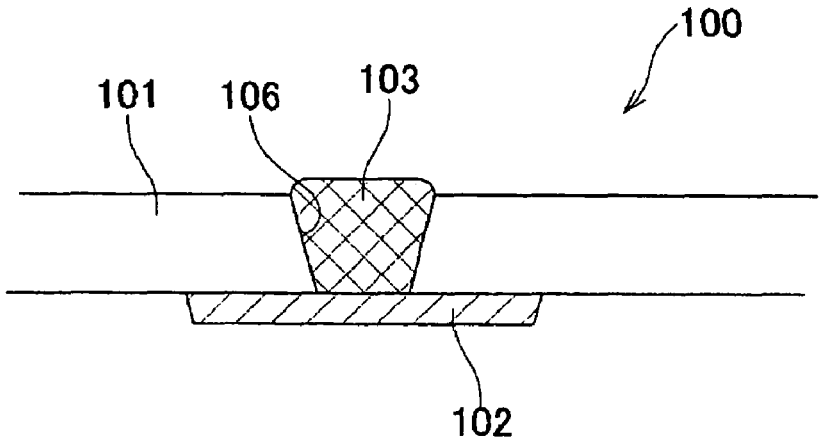
FIG. 7 shows a cross-sectional view along the line VII-VII in FIG. 6(*a*).

Next, the connecting sheet 100 will be described with reference to FIGS. 6 and 7. FIG. 6 shows a plan view of the connecting sheet 100. FIG. 6(*a*) shows a plan view of the connecting sheet 100 seen from the FPC 50 side. FIG. 6(*b*) shows a plan view of the connecting sheet 100 seen from the actuator unit 21 side. FIG. 7 shows a cross-sectional view along the line VII-VII in FIG. 6(*a*). As shown in FIGS. 6(*a*) and 6(*b*), the connecting sheet 100 is provided with an insulating sheet 101 that is rectangular, has a thickness of 50 μm, and consists of a polyimide film. A plurality of first terminals 102 is formed on a first face of the insulating sheet 101 that faces the actuator unit 21. The plurality of first terminals 102 is disposed in a matrix pattern, and is disposed so as to correspond to the input terminals 36 of the actuator unit 21. The outer diameter of the first terminals 102 is approximately 150 μm. Further, a plurality of second terminals 103 is formed on a second face of the insulating sheet 101 that faces the FPC 50. The plurality of second terminals 103 is disposed in a matrix pattern and are disposed so as to correspond to the output terminals 56 of the FPC 50. The outer diameter of the second terminals 103 is approximately 80 μm.

Figure 8:
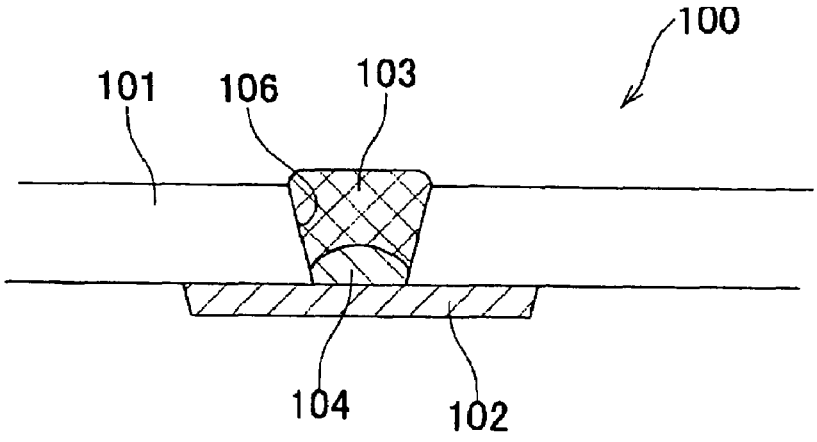
FIG. 8 shows a cross-sectional view showing a variant of the connecting sheet.

As shown in FIG. 7, each first terminal 102 is made of a copper foil (metal piece) fixed to the first face of the insulating sheet 101. The first terminals 102 are formed by electroplating and etching processes. Each first terminal 102 closes a corresponding through holes 106 formed in the insulating sheet 101. The second terminals 103 are formed from a conductive adhesive (filler). The second terminals 103 fill the holes 106, and a part thereof swells out from the other face of the insulating sheet 101. The first terminals 102 and the second terminals 103 are electrically connected. Furthermore, as shown in FIG. 8, a plating layer 104 may be formed on the face of the first terminals 102 within the through hole 106. This means that the first terminals 102 and the second terminals 103 have a more reliable electrical connection.

Figure 9:
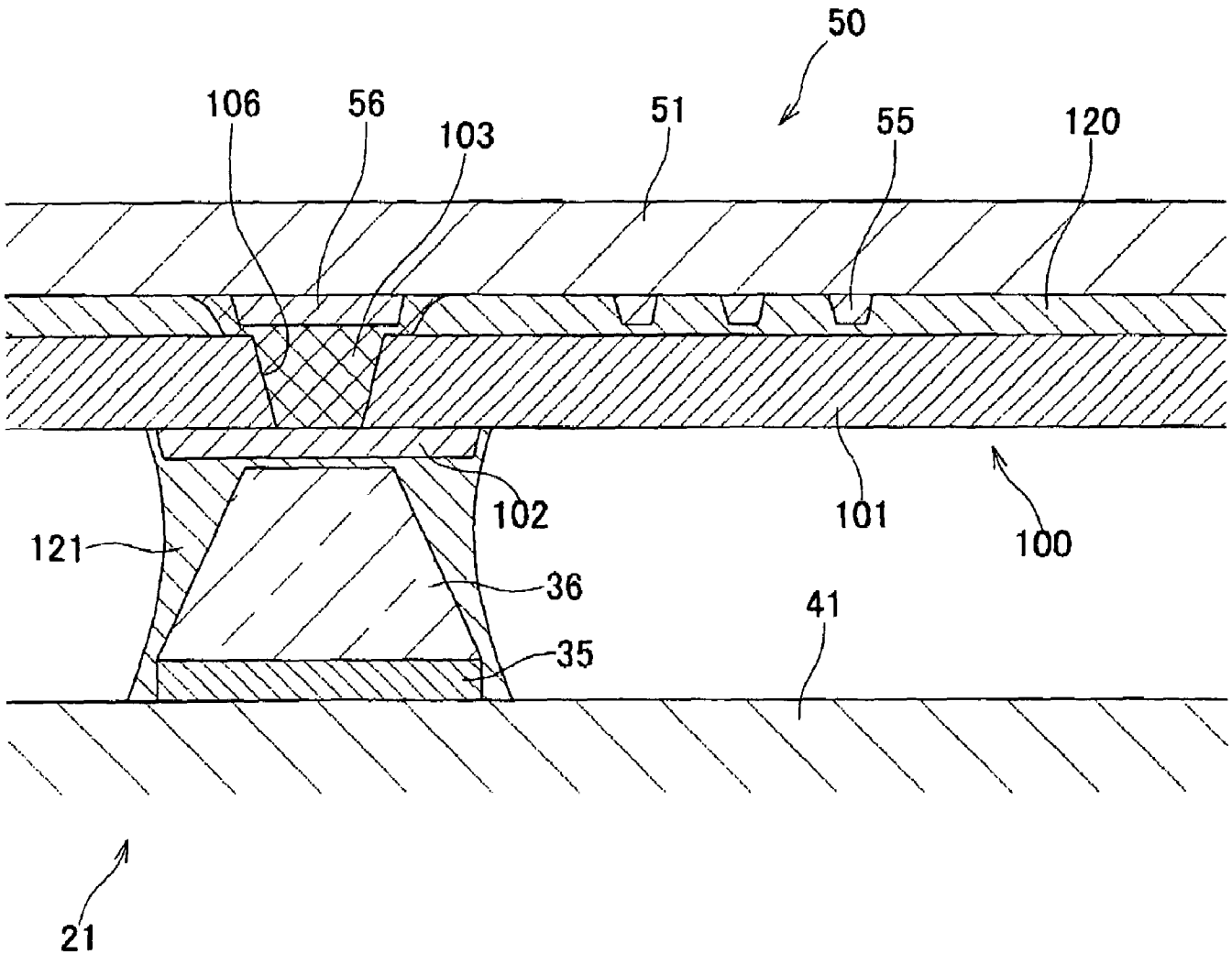
FIG. 9 shows a cross-sectional view showing a connected state of the actuator unit, the connecting sheet, and the FPC.

Next, a connected state of the actuator unit 21, the connecting sheet 100, and the FPC 50 will be described with reference to FIG. 9. FIG. 9 shows a cross-sectional view showing the connected state of the actuator unit 21, the connecting sheet 100, and the FPC 50. As shown in FIG. 9, the input terminals 36 of the actuator unit 21 and the first terminals 102 of the connecting sheet 100 are connected by means of a conductive adhesive 121. Moreover, a gap is maintained between the actuator unit 21 and the connecting sheet 100, this gap corresponding to the height of the input terminals 36. The second terminals 103 of the connecting sheet 100 and the output terminals 56 of the FPC 50 are mutually connected. An insulating material 120 is heated and poured in a molten state to fill a gap between the connecting sheet 100 and the FPC 50. The insulating material 120 seals the driving signal lines 55 and connecting parts of the second terminals 103 and the output terminals 56. Each of the individual electrodes 35 of the actuator unit 21 is thus electrically connected with the driver IC 80 via, in sequence, the corresponding input terminal 36, the corresponding first terminal 102, the corresponding second terminal 103, the corresponding output terminal 56, and the corresponding driving signal line 55. Although this is not shown, the common electrode 34 is earthed via, in sequence, the common electrode terminals 37, the first terminals 102, the second terminals 103, and the common terminal 53.

Next, the method of driving the actuator unit 21 will be described. The direction of polarization of the piezoelectric sheet 41 of the actuator unit 21 is its direction of thickness. The actuator unit 21 has a 'unimorph' type structure wherein the piezoelectric sheet 41 at its upper side (i.e. the opposite side from the pressure chamber 10 side) is an active layer, and the three piezoelectric sheets 42 to 44 at its lower side (the pressure chamber 10 side) are non-active layers. In the case where, for example, the electric field and the polarization have the same direction, and when the individual electrodes 35 have a predetermined positive or negative voltage, a portion of the piezoelectric sheet 41 to which the electric field is applied (the portion between the electrodes) functions as an active layer, and the piezoelectric sheet 41 contracts in a direction at a right angle to the direction of polarization due to horizontal piezoelectric effects. Conversely, the piezoelectric sheets 42 to 44 do not receive the effects of the electric field, and therefore do not contract spontaneously. There is thus a difference in bending, in the direction perpendicular to the direction of polarization, between the upper piezoelectric sheet 41 and the lower piezoelectric sheets 42 to 44, and all the piezoelectric sheets 41 to 44 deform so as to protrude towards the non-active side (unimorph deformation). Since a lower face of the piezoelectric sheets 41 to 44 is fixed to the upper face of the cavity plate 22 that partitions the pressure chambers, as shown in FIG. 4, the piezoelectric sheets 41 to 44 deform so as to protrude towards the pressure chamber side at this juncture. As a result, the volume of the pressure chambers 10 is reduced, the pressure of the ink increases, and the ink is discharged from the corresponding nozzles 8. Then, the individual electrodes 35 are returned to having the same voltage as the common electrode 34, the piezoelectric sheets 41 to 44 return to their original shape, and since the volume of the pressure chambers 10 returns to its original volume, ink is drawn in from the manifold 5 side.

Next, the method of manufacturing the ink jet head 1 will be described. First, the actuator unit 21 is made by a step of joining the plurality of individual electrodes 35, the piezoelectric sheets 41 to 44, and the common electrode 34 by means of adhesive. Further, the ink flow channel unit 4 is made by a step of using adhesive to pressure bond the cavity plate 22, the base plate 23, the aperture plate 24, the supply plate 25, the manifold plates 26, 27, and 28, the cover plate 29, and the nozzle plate 30. Then the main body 70 is made by a step (see FIG. 3: a step of preparing the main body) of using adhesive to bond the actuator unit 21 and the ink flow channel unit 4.

The wired pattern is formed on the plate shaped base 51. The covered region 50*b* comprising the insulating film 57 is formed on the non-facing region of the base 51. The FPC 50 is made by a step of mounting the driver IC 80 (a step of preparing the wired sheet).

The connecting sheet 100 is formed by a step (a step of preparing the connecting sheet) in which holes 106 are formed by a laser process in the insulating sheet 101, the first terminals 102 are fixed to the first face of the insulating sheet 101 to close the holes 106, and the second terminals 103 are formed by filling the conductive adhesive into the holes 106 such that this adhesive swells out from the other face of the insulating sheet 101. In the step for making the connecting sheet 100, the first terminals 102 may be fixed in advance to the first face of the insulating sheet 101, the holes may be formed by a laser process so as to pass through both the insulating sheet 101 and the first terminals 102, and then these holes may be filled with the conductive adhesive. Further, the method of forming the holes is not restricted to the laser process. Other methods, such as an etching process, etc. may be used.

In the aforementioned step, the second terminals 103 are formed by filling the interior of the holes 106 with the conductive adhesive after these holes 106 have been covered by the first terminals 102 at the first face of the insulating sheet 101. It is thus easy to cause the second terminals 103 to swell out from the second face of the insulating sheet 101. As a result, the second terminals 103 and the output terminals 56 of the FPC 50 can be made to join reliably.

Figure 10:
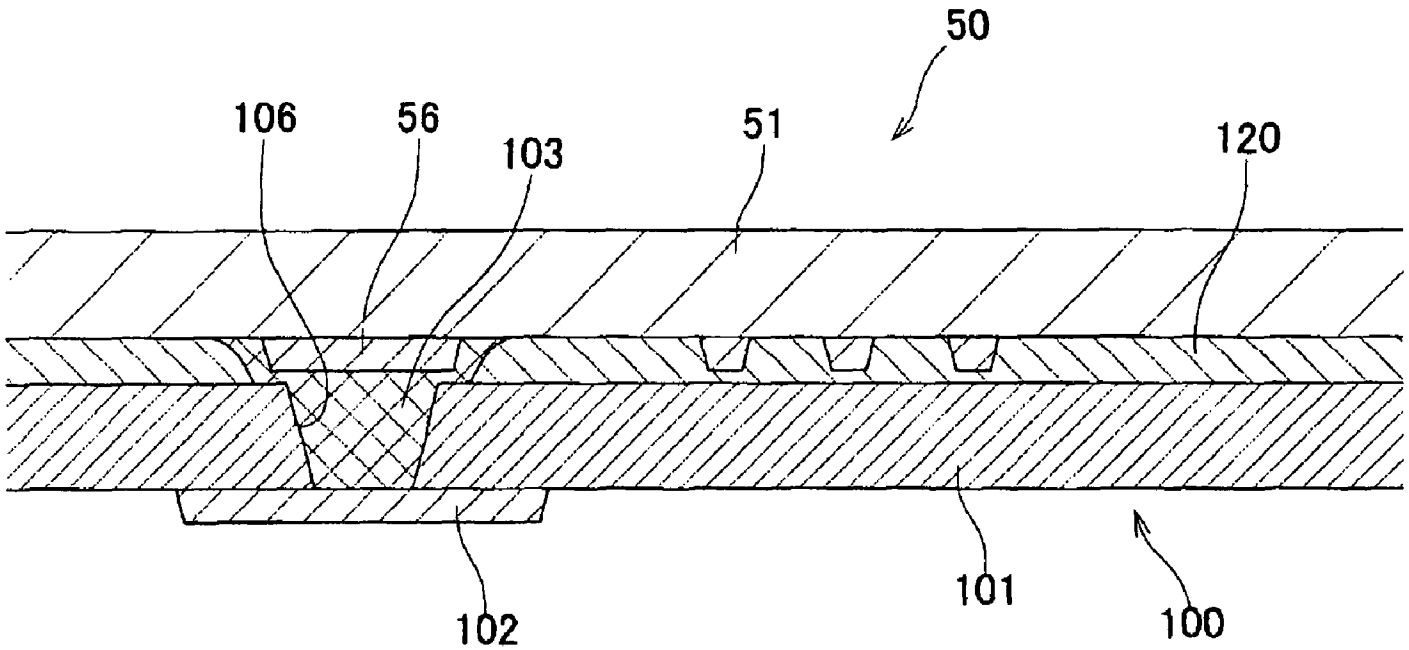
FIG. 10 shows a figure for describing a step of joining an output terminal and a second terminal.

Next, as shown in FIG. 10, the FPC 50 and the connecting sheet 100 are overlapped, and the output terminals 56 and the second terminals 103 are connected with one another. Further, a composite sheet is made by a step (a step of filling the insulating material) of filling the gap between the FPC 50 and the connecting sheet 100 with the insulating material 120. This step is performed by heating the insulating material 120 and pouring it in a molten state between the FPC 50 and the connecting sheet 100, this insulating material 120 cooling naturally and solidifying. Next, the composite sheet is disposed above the actuator unit 21, and the input terminals 36 and the first terminals 102 are connected by means of the conductive adhesive 121. During each of the connecting steps, the conductive adhesive is pre-heated to a semi-hardened state, is then temporarily solidified, is then re-heated, and the conductive adhesive is fully hardened. The manufacture of the ink jet head 1 is completed by means of the above steps.

With the ink jet head 1 of the present embodiment, the connecting sheet 100 is present between the main body 70 and the FPC 50. As a result, dust, splashes of ink that have been splashed from the main body 70 side, etc., are prevented from adhering to the FPC 50. By this means, the input terminals 36 of the actuator unit 21 are prevented from short circuiting with the other driving signal lines 55, and the driving signal lines 55 are prevented from short circuiting with one another.

With the connecting sheet 100 of the present embodiment, the outer diameter of the first terminals 102 is larger than the outer diameter of the second terminals 103. By this means, the second terminals 103 are prevented from short circuiting with the other driving signal lines 55. Furthermore, the first terminals 102 and the input terminals 36 of the actuator unit 21 can be connected easily.

With the composite sheets 50 and 100 of the present embodiment, the insulating material 120 fills the gap between the FPC 50 and the connecting sheet 100. By this means, the driving signal lines 55 can reliably be prevented from short circuiting with one another due to dust, splashes of ink, etc.

With the FPC 50 of the present embodiment, only the region not covered by the central base plate 100 is covered by the insulating film 57. Further, the output terminals 56 are not formed in the covered region 50*a* that is covered by the insulating film 57. By this means, it is not necessary to form an insulating film that has minute holes, and consequently the manufacturing cost of the FPC 50 can be reduced.

With the connecting sheet 100 of the present embodiment, the insulating sheet 101 that has holes therein is used, the first terminals 102 are configured from metal pieces that are fixed so as to close openings of those holes 106 at the first face, and the second terminals are configured from conductive adhesive (filler) that is filled into the holes 106 with a portion of this adhesive swelling out from the second face of the insulating sheet 101. By this means, the connecting sheet 100 with terminals on both faces can be formed with, at least, a smaller number of parts and without waste.

With the actuator unit 21 of the present embodiment, the actuators that apply pressure to the plurality of pressure chambers 10 have been unitized. By this means, control over the manufacture of the ink jet head 1 becomes easier.

With the manufacturing method of the ink jet head of the present embodiment, the output terminals 56 of the FPC 50 and the second terminals 103 of the connecting sheet 100 are formed into a composite sheet by means of a connecting step, and then the conductive adhesive 121 is used to connect the input terminals 36 of the actuator unit 21 and the first terminals 102 of the connecting sheet 100. By this means, the output terminals 56 of the FPC 50 and the second terminals 103 of the connecting sheet 100 can be connected without placing excess load on the actuator unit 21.

With the manufacturing method of the ink jet head of the present embodiment, the step of connecting the output terminals 56 of the FPC 50 and the second terminals 103 of the connecting sheet 100 is followed by the step of filling the gap between the FPC 50 and the connecting sheet 100 with the insulating material 120. Consequently, at least a part of the wired pattern exposed at the non-covered region 50*a* of the FPC 50 can be covered by the insulating material 120. By this means, the driving signal lines 55 can be sealed reliably without forming the insulating film that has minute holes. The FPC 50 can be manufactured cheaply.

Figure 11:
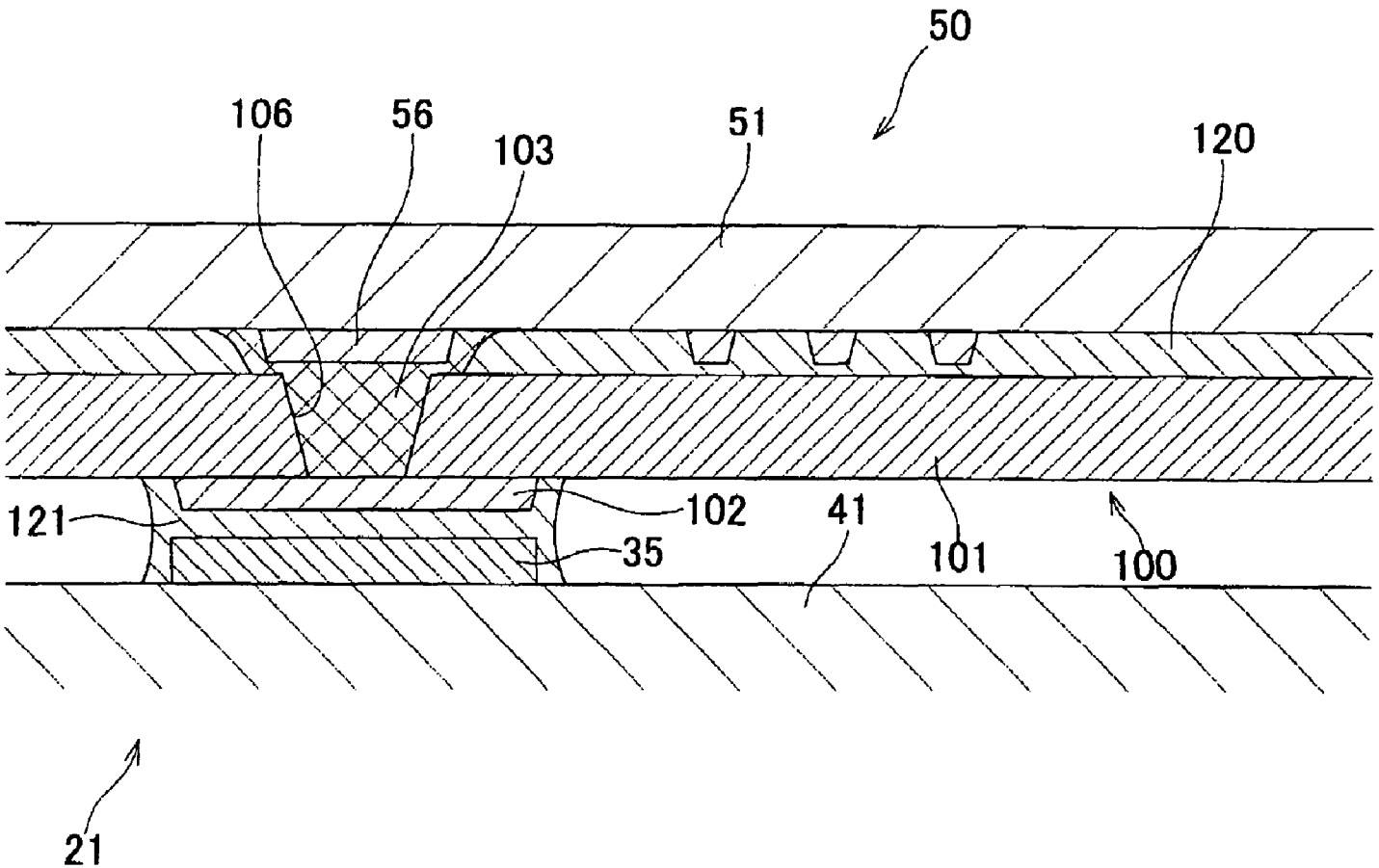
FIG. 11 shows a cross-sectional view showing a variant of the actuator unit.

With the present embodiment, the actuator unit 21 is provided with the input terminals 36 that are electrically connected with the individual electrodes 35. However, the actuator unit 21 can also have a configuration in which it is not provided with the input terminals 36. In that case, as shown in FIG. 11, the first terminals 102 and the individual electrodes 35 may be connected by means of a conductive adhesive while maintaining a clearance between the connecting sheet 100 and the actuator unit 21. In this case, a part of the individual electrodes 35 functions as the input terminal 36. By this means, the step can be omitted of forming the input terminals 36 separately.

An embodiment of the present invention has been described in detail above. However, this merely illustrates some possibilities of the invention and does not restrict the claims thereof The art set forth in the claims encompasses various transformations and modifications to the embodiment described above.

Figure 12:
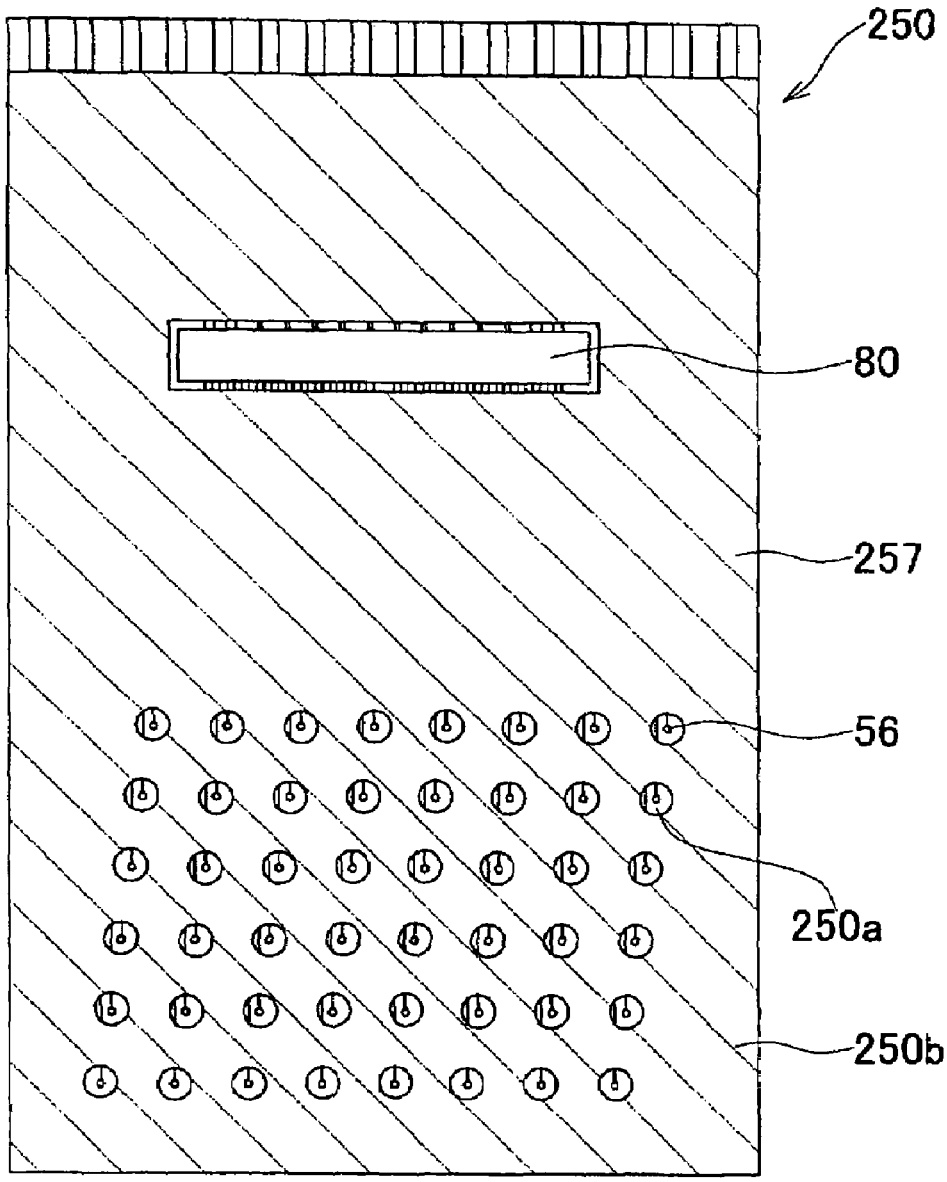
FIG. 12 shows a plan view showing a variant of the FPC.

The FPC 50 of the present embodiment has a configuration in which all of the output terminals 56 and a part of the driving signal lines 55 connected therewith are exposed in the non-covered region 50*a*. Instead, the configuration of an FPC 250 shown in FIG. 12 may be adopted. In the FPC 250, regions with a radius of 250 μm or greater, and in which the output terminals 56 are at the center, form a plurality of non-covered regions 250*a* that are not covered by an insulating film 257. In this case, it is preferred that one output terminal 56 is exposed in a different corresponding non-covered region 250*a*. With this FPC 250, the insulating film 257 increases the flatness of the FPC 250, and the output terminals 56 and the second terminals 103 can be connected more efficiently. Furthermore, it is possible to prevent the driving signal lines 55 from short circuiting with one another without filling the insulating material 120 into the gap between the FPC 50 and the connecting sheet 100. One output terminal 56 and its adjacent signal line may be exposed in each of non-covered regions 250*a*. Even though the second terminals are connected with the output terminals, the small diameter of the second terminals of the connecting sheet 100 makes it possible to realize a positional relationship in which the second terminals do not make contact with the adjacent signal lines for another output terminals.

With the connecting sheet 100, the outer diameter of the first terminals 102 may be the same as the outer diameter of the input terminals 36, and the outer diameter of the first terminals 102 may be smaller than the outer diameter of the second terminals 103.

The insulating material 120 does not necessarily have to be filled between the FPC 50 and the connecting sheet 100.

With the connecting sheet 100, metal pieces that form terminals may be fixed to both sides of the insulating sheet, and these metal pieces may be electrically connected via through holes formed in the insulating sheet. Further, the terminals on both faces may be configured differently.

In the case where the ink jet head is manufactured, the step of connecting the output terminals 56 of the FPC 50 and the second terminals 103 of the connecting sheet 100 may be performed simultaneously with the step of connecting the first terminals 102 of the composite sheet 50, 100 with the input terminals 36 of the actuator unit 21.

The actuator unit 21 is not restricted to a type that uses piezoelectric sheets. The actuator unit may equally well be a type in which, on the basis of driving signals transmitted from the FPC 50, the ink in the pressure chambers 10 is heated, and discharging energy is applied to the ink in the pressure chambers 10.

Furthermore, the technical elements disclosed in the present specification or figures may be utilized separately or in all types of conjunctions and are not limited to the conjunctions set forth in the claims at the time of submission of the application. The art disclosed in the present specification or figures may be utilized to simultaneously realize a plurality of aims or to realize one of these aims.

What is claimed is:

1. An ink jet head comprising:

a main body comprising a plurality of sets, each set including an input terminal, an actuator electrically connected to the input terminal, a pressure chamber coupled with the actuator, and a nozzle communicated with the pressure chamber, wherein when a voltage is applied to the actuator in a selected set via the input terminal in the selected set, ink within the pressure chamber in the selected set receives pressure to jet from the nozzle in the selected set;

a wired sheet comprising a plurality of sets, each set including a signal line and an output terminal connected to the signal line; and a connecting sheet comprising an insulating sheet and a plurality of sets, each set including a first terminal formed on a first face of the insulating sheet and a second terminal formed on a second face of the insulating sheet and electrically connected to the first terminal, wherein each set of the connecting sheet uniquely corresponds to one of the sets of the main body and to one of the sets of the wired sheet;

wherein the connecting sheet is located between the main body and the wired sheet, the first terminal in each set of the connecting sheet is electrically connected to the input terminal in the corresponding set of the main body, and the second terminal in each set of the connecting sheet is electrically connected to the output terminal in the corresponding set of the wired sheet.

2. An ink jet head as in claim 1, wherein the input terminals are distributed on a face of the main body, the output terminals are distributed on a face of the wired sheet, and the connecting sheet is located between the face of the main body and the face of the wired sheet.

3. An ink jet head as in claim 1, wherein an outer dimension of each first terminal is larger than an outer dimension of each second terminal.

4. An ink jet head as in claim 1, wherein at least a part of a gap between the wired sheet and the connecting sheet is filled with an insulating material.

5. An ink jet head as in claim 2, wherein the face of the wired sheet comprises a region covered with an insulating layer and a non-covered region not covered with the insulating layer, and the plurality of output terminals and a part of the plurality of the signal lines are exposed in the non-covered region.

6. An ink jet head as in claim 2, wherein the face of the wired sheet comprises a region covered with an insulating layer and a plurality of non-covered regions not covered with the insulating layer, and each output terminal is exposed in a different corresponding non-covered region.

7. An ink jet head as in claim 1, wherein the connecting sheet comprises:

the insulating sheet having a plurality of through holes;

a plurality of metal pieces, each metal piece sealing an opening of a different corresponding through hole at the first face; and a plurality of conductive fillers, each filler filling a different corresponding through hole and swelling from the second face, whereby each metal piece comprises at least a part of one of the first terminals and each swelled portion of each conductive filler comprises at least a part of one of the second terminals.

8. An ink jet head as in claim 1, wherein the main body comprises:

a channel unit having a plurality of sets, each set including the pressure chamber and the nozzle; and an actuator unit coupled with the channel unit, the actuator unit comprising:

a plurality of input terminals;

a plurality of individual electrodes, each individual electrode being electrically connected to a different corresponding input terminal and being coupled with a different corresponding pressure chamber;

a single common electrode extending over the plurality of pressure chambers; and a piezoelectric layer located between the plurality of individual electrodes and the single common electrode.

9. A connecting sheet for an ink jet head, the ink jet head comprising, a main body comprising a plurality of sets, each set including an input terminal, an actuator electrically connected to the input terminal, a pressure chamber coupled with the actuator, and a nozzle communicated with the pressure chamber, wherein when a voltage is applied to the actuator in a selected set via the input terminal in the selected set, ink within the pressure chamber in the selected set receives pressure to jet from the nozzle in the selected set, and a wired sheet comprising a plurality of sets, each set including a signal line and an output terminal connected to the signal line, the connecting sheet comprising:

an insulating sheet made of insulating material; and a plurality of sets, each set including a first terminal formed on a first face of the insulating sheet and a second terminal formed on a second face of the insulating sheet and electrically connected to the first terminal, wherein each set of the connecting sheet uniquely corresponds to one of the sets of the main body and to one of the sets of the wired sheet, and the connecting sheet is to be located between the main body and the wired sheet, to be fixed to the main body such that the first terminal in each set of the connecting sheet is to be electrically connected to the input terminal in the corresponding set of the main body, and to be fixed to the wired sheet such that the second terminal in each set of the connecting sheet is to be electrically connected to the output terminal in the corresponding set of the wired sheet.

10. A composite sheet for an ink jet head comprising a main body comprising a plurality of sets, each set including an input terminal, an actuator electrically connected to the input terminal, a pressure chamber coupled with the actuator, and a nozzle communicated with the pressure chamber, wherein when a voltage is applied to the actuator in a selected set via the input terminal in the selected set, ink within the pressure chamber in the selected set receives pressure to jet from the nozzle in the selected set, the composite sheet comprising:

a wired sheet comprising a plurality of sets, each set including a signal line and an output terminal connected to the signal line; and a connecting sheet comprising an insulating sheet and a plurality of sets, each set including a first terminal formed on a first face of the insulating sheet and a second terminal formed on a second face of the insulating sheet and electrically connected to the first terminal, wherein each set of the connecting sheet uniquely corresponds to one of the sets of the main body and to one of the sets of the wired sheet, and the connecting sheet is fixed to the wired sheet such that the second terminal in each set of the connecting sheet is electrically connected to the output terminal in the corresponding set of the wired sheet, and wherein the first terminal in each set of the connecting sheet is to be electrically connected to the input terminal in the corresponding set of the main body.

* * * * *